United States Patent [19]

Robinson

[11] 4,224,257

[45] Sep. 23, 1980

[54] COOLING TOWER CONSTRUCTION AND FILL

[76] Inventor: Elbert W. Robinson, 223 Amarillo Bldg., Amarillo, Tex. 79101

[21] Appl. No.: 31,632

[22] Filed: Apr. 19, 1979

[51] Int. Cl.[2] ..... B01F 3/04

[52] U.S. Cl. ..... 261/23 R; 261/98; 261/111; 261/DIG. 11; 261/DIG. 72

[58] Field of Search ..... 261/DIG. 11, 112, DIG. 72, 261/23 R, 94, 95, 98, 108, 111; 48/180 R, 180 M; 123/141

[56] References Cited

U.S. PATENT DOCUMENTS

| | | | |
|---|---|---|---|
| 522,549 | 7/1894 | Barnard | 261/DIG. 72 |
| 1,293,270 | 2/1919 | Webb | 261/DIG. 72 |
| 2,183,657 | 12/1939 | Page | 261/DIG. 72 |
| 2,872,168 | 2/1959 | Mart | 261/23 R |
| 3,219,577 | 11/1965 | Powers | 261/DIG. 72 |
| 3,243,166 | 3/1966 | Rosenga et al. | 261/23 |
| 3,468,521 | 9/1969 | Furlong et al. | 261/DIG. 11 |
| 3,493,219 | 2/1970 | Stachowiak et al. | 261/103 |
| 3,589,518 | 6/1971 | Brebion et al. | 261/112 |
| 3,652,066 | 3/1972 | Faigle | 261/112 |
| 3,743,256 | 7/1973 | Oplatka | 261/DIG. 72 |
| 3,870,485 | 3/1975 | Shiraishi et al. | 261/DIG. 72 |

FOREIGN PATENT DOCUMENTS

| | | | |
|---|---|---|---|
| 391083 | 8/1908 | France | 48/180 R |
| 464433 | 4/1937 | United Kingdom | 261/112 |
| 571510 | 8/1945 | United Kingdom | 261/112 |

*Primary Examiner*—Tim R. Miles

*Attorney, Agent, or Firm*—Clarence A. O'Brien

[57] ABSTRACT

A cooling tower has a plurality of cooling regions with each cooling region being constructed in a cross flow or counter flow configuration for allowing air to pass into the path of falling water within that region. Each region contains a fill bundle composed of twisted fill elements. Each fill element consists of an elongated substantially flat member which is twisted normally about its longitudinal axis. A plurality of the fill elements are connected in rows and placed in the path of the air circulation. Alternate rows will be offset from adjacent rows disposing the elements at apices of an isosceles triangle pattern to obtain equal spacing between adjacent elements and create a circuitous route through which the cooling air must pass. The spiral configuration of the elements provides centrifugal action which disperses the water and air from one element to adjacent elements, thus providing more intimate contact between the water and the cooling air.

13 Claims, 6 Drawing Figures

COOLING TOWER CONSTRUCTION AND FILL

BACKGROUND OF THE INVENTION

1. Field of the Invention

This invention relates to the construction and configuration of cooling tower components and especially to those components constituting the fill or packing of the cooling tower and which function to provide a large surface area over which warm water may pass in thin films in order to enhance removal of heat through intimate contact with large volumes of air.

2. Description of Related Art

The use of cooling towers for removal of heat from liquid, usually water, is very old. Advances in the technology have resulted in many improvements in the design of cooling tower components, both internal and external. The internal components, notably the fill elements and the mist eliminators, have received the most attention since they have the greatest influence on the tower performance. Early tower designs utilized thin wood slats installed in various patterns for fill elements. Such fill elements are subject to early failure due to rot, erosion, and ice-loading and have now been largely replaced by plastic fills of several differing designs, each of which is claimed to effect improvements in some of the requirements of an ideal fill.

U.S. Pat. No. 3,493,219, issued Feb. 3, 1970 to Stachowiak et al, shows a trickle unit for use in cooling towers which includes a pair of coplanar arrays of horizontally spaced vertical tubes with corresponding tubes being spanned by vertical sheets of fabric. The fabric is a warp knit having a multiplicity of continuous knitted ribs formed by the loop wales which are effective to mix the water film and create turbulence therein. U.S. Pat. No. 4,009,751, issued Mar. 1, 1977 to Zelnik, shows an apparatus for heat and/or mass transmission between two or more phases. The Zelnik devices includes a helical guide for both phases inside a column flowing either in a counter current or in no current. The column includes a helical insert on its internal surface so that it forms a continuous channel for the phase with the highest specific mass and another helical insert for causing the phase with the lower specific mass to flow along a helical track within the inner space of the column. U.S. Pat. No. 2,907,707, issued Oct. 6, 1959 to Wintermute, shows a gas and a liquid contact apparatus. The Wintermute apparatus includes a plurality of substantially cylindrical chambers with each chamber having a helical electrode supported concentrically within it. A controlled volume of liquid is deposited on the electrode and the gas is introduced into the chamber for making contact with the liquid. U.S. Pat. No. 3,675,710, issued July 11, 1972 to Ristow discloses a vapor condenser which includes condensing tubes having spiral strips disposed therein for extending the flow path of vapor within the tubes.

SUMMARY OF THE INVENTION

The present invention includes a cooling tower construction having a plurality of cooling regions and a centrally located warm water distributing region for directing warm water to be cooled to the various cooling regions. Each cooling region incorporates fill composed of a plurality of fill elements. Each fill element is a relatively thin elongated strip normally twisted about its longitudinal axis. A plurality of fill elements are arranged in vertically disposed rows and a plurality of rows is placed in each cooling region. Adjacent rows are offset so that the individual fill elements are disposed in an isosceles triangle configuration. In this manner, cross flow air circulation is forced between the fill elements thereby imparting a sinuous motion to the air to enhance the air-water contact within the cooling region. Furthermore, the warm water and counter flow air circulation is forced through a spiral path along the fill elements thereby increasing the path of travel of the water and air and prolonging the water-air contact. Additionally, the spiral configuration of the fill elements imparts a centrifugal force to the water and counter flow air causing deflection of the water and air between adjacent elements, thus providing a more intimate contact between the air and water.

Accordingly, one object of the present invention is to provide a cooling tower construction and fill which can be incorporated in either cross flow cooling towers or counter flow cooling towers for increasing the air-water contact therein.

Another object of the present invention is to provide a cooling tower construction and fill which is relatively inexpensive to manufacture yet efficient in use.

Yet a still further object of the present invention is to provide a cooling tower construction and fill wherein each fill element is formed of a relatively thin elongated strip having a normal twist to the longitudinal axis of the element.

A still further object of the present invention is to provide a cooling tower construction and fill wherein a plurality of twisted fill elements are arranged into a bundle of convenient dimensions to facilitate handling and installation.

One still further object of the present invention is to provide a cooling tower construction and fill wherein the individual twisted elements composing the bundle are arranged in rows with alternate rows being offset so that the fill elements are arranged in an isosceles triangle pattern to obtain equal spacing between all elements and a tighter fill construction.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
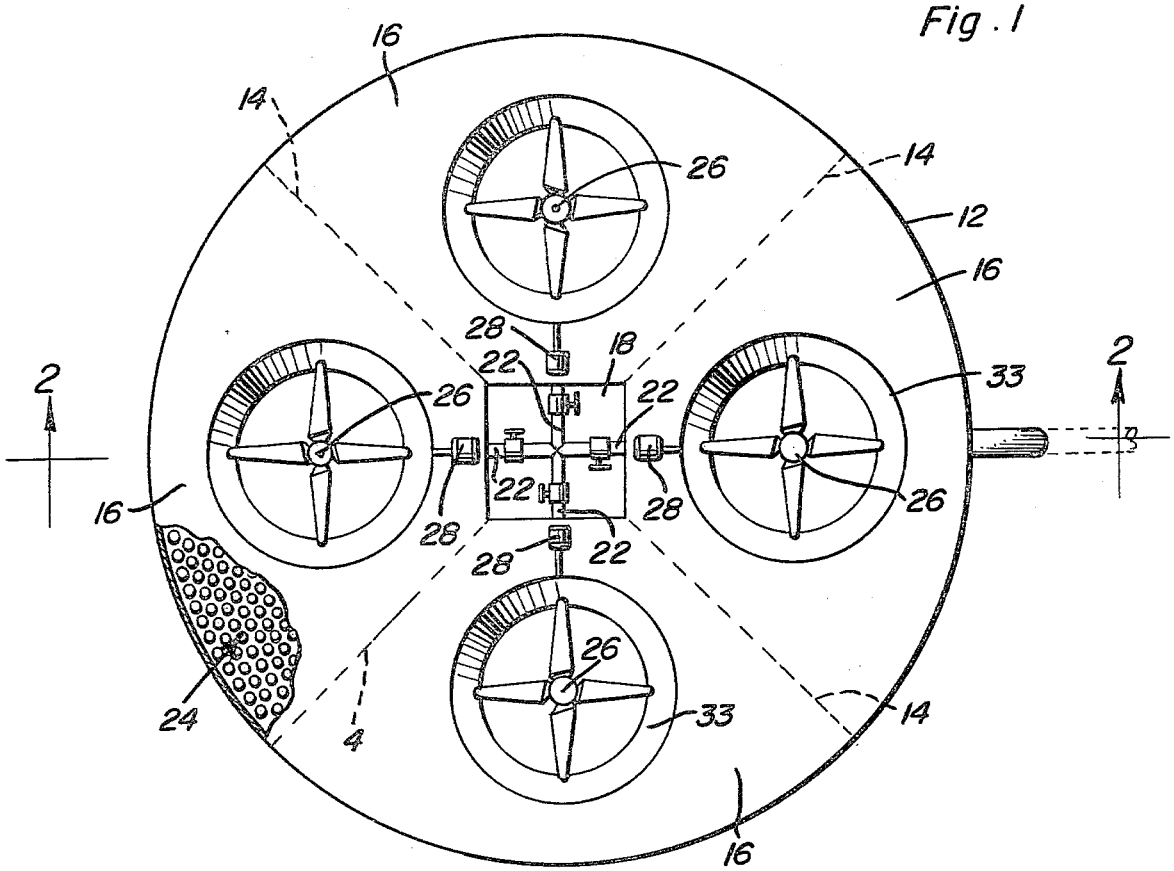
FIG. 1 shows a top plan view of a cooling tower incorporating the present invention.
Figure 2:
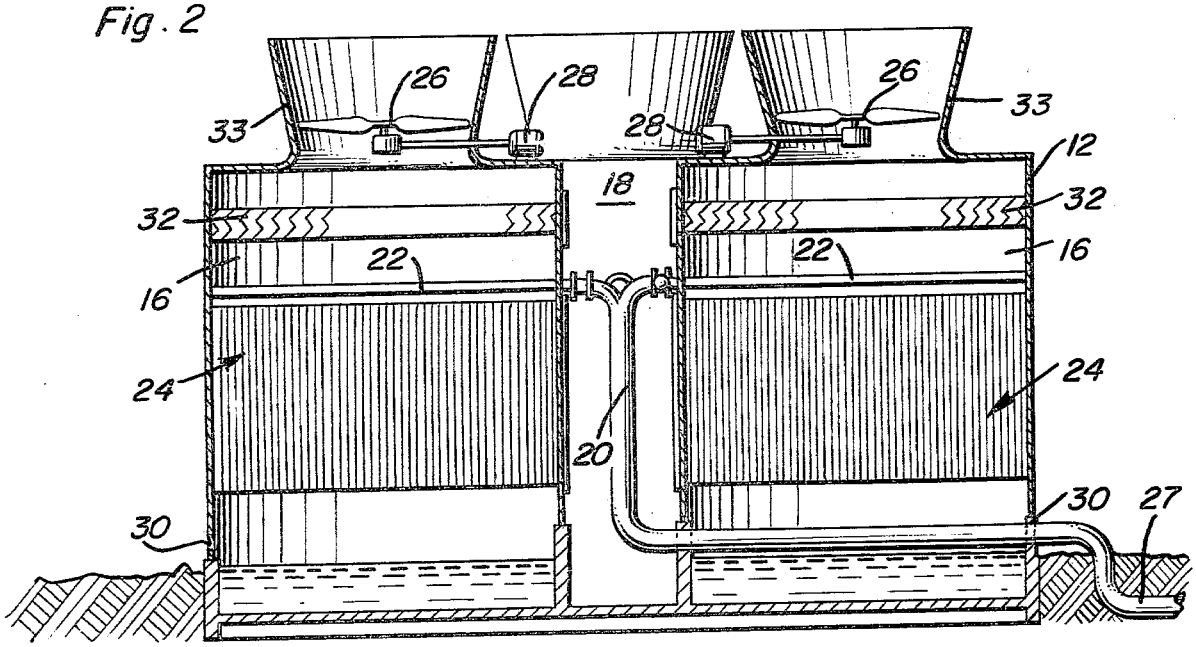
FIG. 2 is an elevational sectional view taken substantially along a plane passing through section line 2—2 of FIG. 1.

Now with reference to the drawings, the cooling tower construction and the fill of the present invention will be described in detail. With particular reference to FIGS. 1 and 2, a counter flow cooling tower generally designated by the numeral 10 can be seen to include a single outer peripheral wall 12 and four radially extending partitions 14 which divide the cooling tower into four cooling regions or cells 16. Partitions 14 extend radially outward from a centrally located plenum 18 in which is a disposed riser 20. Riser 20 is an extension of outlet 27 which transports spent fluid from large electric generating plants such as steam turbine generating facilities. Riser 20 branches into four valved distributor headers 22 which extend radially outward, into each cell 16 and include well known spray heads for dispensing the warm liquid onto fill packing 24. Cooling air is drawn vertically upward through fill packing 24 by fans 26 which are operated by their respective motors 28. The cooling air is pulled into the cell 16 through openings 30 which are disposed in the lower portion of each cell. The cooling air is drawn upward through fill packing 24 and then through eliminators 32 which comprise, for example, baffles angled so that moisture laden air will impinge thereon thereby separating the moisture from the air causing the moisture to drop back down onto the fill 24. The cooling air then travels through venturi-shaped fan housings 33 and exits each section through the top of its respective fan housing.

Figure 5:
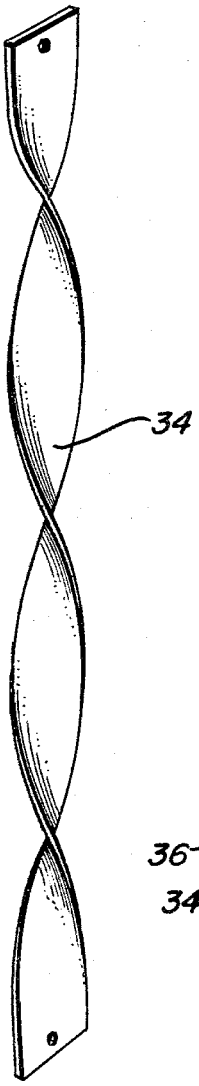
FIG. 5 is a perspective view of one twisted fill element.

Now with respect to FIG. 5, it can be seen that each fill element 34 of fill packing 24 consists of an elongated strip of any suitable material such as plastic, metal, coated metal, or ceramic. The fill element may have either solid or perforated surfaces and is twisted normally about its longitudinal axis any number of turns from fractional to whole numbers depending upon the strength and rigidity of the element. As is evident by inspection of FIG. 5, the twist of the fill element provides a helical path for fluid to descent along thereby increasing the fluid flow path from top to bottom as well as presenting the fluid to air circulation on all sides as it traverses the element. A similar helical path is traversed by counter flow cooling air, while if the element is used in a cross flow cooling tower, the cooling air would impinge on the fill element from a direction normal to the element.

Figure 3:
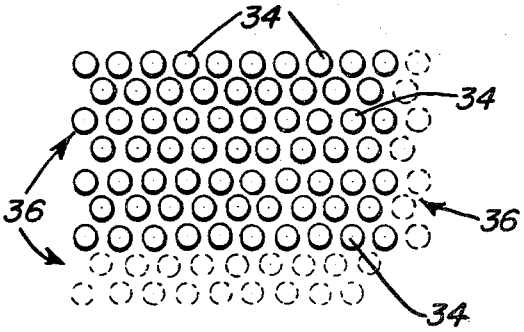
FIG. 3 is a top plan view of a bundle of twisted fill elements of the present invention.

Furthermore, the helical configuration of the fill elements 34 imparts a centrifugal force to any liquid flowing vertically downward along the element and any cooling counter flow air. This centrifugal force tends to disperse the liquid and air laterally of the element. For this reason, individual elements are disposed in an isosceles triangle configuration to minimize distance between the elements. As seen in FIG. 3, the elements 34 are disposed in rows with adjacent rows offset to afford the triangular, close pack configuration necessary. In this manner, liquid travels from one element to adjacent elements. The counter flow cooling air is similarly dispersed.

If the fill elements are disposed in a cross flow cooling tower, the liquid would be spread from element to element while the cross flow cooling air would be forced to travel in a circuitous route past each element due to the staggered nature of rows 36. It should also be noted that the fill elements can be disposed in a horizontal plane with the rows being staggered from top to bottom. With the elements disposed horizontally, the warm liquid to be cooled would fall from one element to another while counter flow air would also be forced to travel through a circuitous route between the elements of the adjacent rows.

Figure 4:
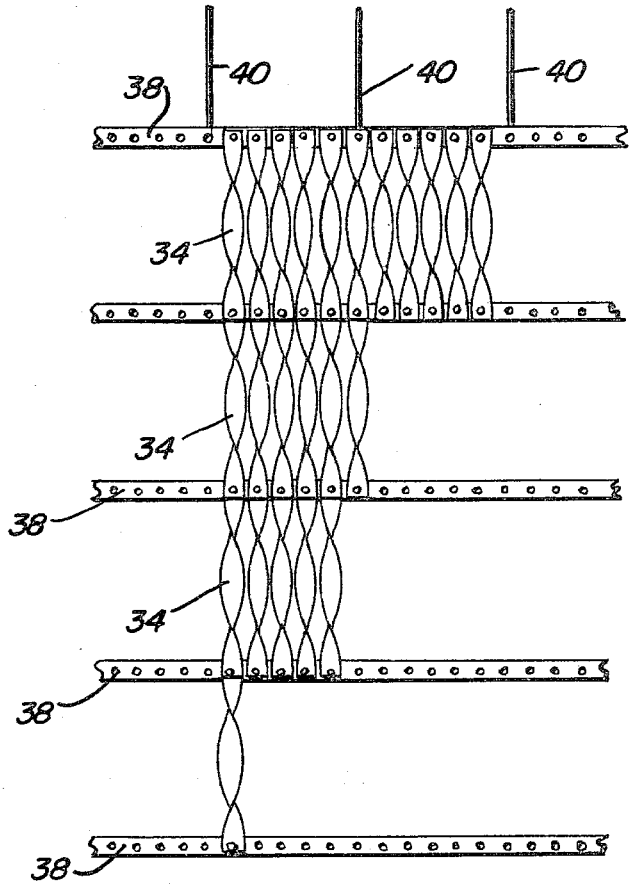
FIG. 4 is a side elevational view of a second bundle embodiment comprising a plurality of twisted fill elements of the present invention.

One convenient method of arranging the fill elements can be seen in FIG. 4 wherein individual elements 34 are arranged in longitudinally aligned relation with individual elements of adjacent rows, with each row spanning two of the stringers 38. Each of the longitudinally aligned arrangements can be suspended by a plurality of suspension wires 40 for providing vertically disposed fill. If the fill is to be disposed horizontally, additional wires 40 would be connected to the stringer 38 on the opposite end of the arrangement of FIG. 4. A plurality of such arrangements can be provided in a staggered manner in any cooling tower.

Figure 6:
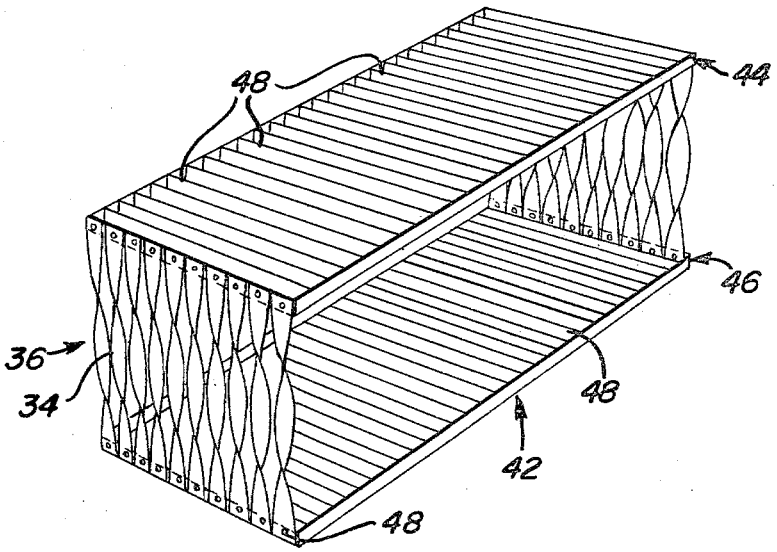
FIG. 6 is an enlarged plan view showing the relationship between individual fill elements in a bundle.

FIG. 6 shows an even more convenient arrangement of fill elements formed in a bundle 42. Bundle 42 consists of upper and lower rectangular frame members 44 and 46 each of which contains a plurality of lateral members 48. Individual fill elements are arranged in rows with the rows spanning the distance between vertical aligned lateral members 48. The rows, of course, would be staggered as discussed hereinabove. For the sake of clarity, only the first and last rows of elements 34 are shown connected in bundle 42. A plurality of bundles 42 can easily be stacked with the fill elements disposed in either a horizontal or vertical position as desired in a cooling tower by merely placing one bundle on top of another bundle. Alternatively, the individual bundles can be suspended within the cooling tower if desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is a follows:

1. In a cooling tower having a liquid inlet, a liquid cooling region, a fan in communication with said cooling region for causing air flow within said cooling region, and a liquid spray header connected to said inlet for spraying liquid within said region; fill material disposed beneath said header, said fill material comprising a plurality of individual substantially flat fill elements disposed in a three dimensional array having laterally spaced fill elements, each of said fill elements being elongated and normally twisted about its longitudinal axis, with each fill element being in direct, open liquid transfer relation with each laterally spaced surrounding element to permit liquid and air to travel between said each fill element and said surrounding elements in said array.

2. The structure of claim 1 wherein said fill elements are disclosed in a close packed configuration with any three adjacent elements being disposed at the apexes of an equilateral triangle.

3. The structure of claim 2 wherein said cooling tower is of a modular design having a plurality of cooling regions, each region having an associated cooling fan and spray header, and a centrally located plenum region receiving said inlet and having a riser therein connected to each spray header.

4. The structure of claim 3 wherein said cooling tower is of the cross flow type.

5. The structure of claim 3 wherein said cooling tower is of the counter flow type.

6. The structure of claim 1 wherein said three dimensional array comprises fill elements disposed in rows with a plurality of rows being laterally aligned and connected between upper and lower frame members to form an individual modular unit.

7. The structure of claim 6 wherein adjacent rows are offset from each other by a distance approximately equal to one-half the distance between the individual elements of a single row.

8. The structure of claim 7 wherein said modular units are positioned in said cooling tower with said elements being vertically disposed therein.

9. The structure of claim 7 wherein said modular units are positioned in said cooling tower with said elements being horizontally disposed therein.

10. The structure of claim 1 wherein said three dimensional array comprises fill elements disposed in rows with the individual elements of each row being longitudinally aligned with elements of the next adjacent row to form a substantially flat sheet structure.

11. The structure of claim 10 wherein a plurality of sheets are disposed parallel to one another with the rows of each sheet being offset from the rows of adjacent sheets by a distance equal to approximately one-half the distance between adjacent elements of a single row.

12. The structure of claim 11 wherein said sheets are positioned in said cooling tower with said elements being disposed vertically therein.

13. The structure of claim 11 wherein said sheets are positioned in said cooling tower with said elements being disposed horizontally therein.

* * * * *